US005449016A

United States Patent [19]

van Baar

[11] Patent Number: 5,449,016

[45] Date of Patent: Sep. 12, 1995

[54] SEWAGE SYSTEM

[75] Inventor: Jacobus E. M. van Baar, Bergen, Netherlands

[73] Assignee: Joh. Ranzijn Engineers B.V., Ke Opmeer, Netherlands

[21] Appl. No.: 137,013

[22] PCT Filed: Apr. 14, 1992

[86] PCT No.: PCT/NL92/00070

§ 371 Date: Dec. 9, 1993

§ 102(e) Date: Dec. 9, 1993

[87] PCT Pub. No.: WO92/18714

PCT Pub. Date: Oct. 29, 1992

[30] Foreign Application Priority Data

Apr. 15, 1991 [NL] Netherlands ..... 9100646

[51] Int. Cl.[6] ..... E03F 1/00

[52] U.S. Cl. ..... 137/205; 137/236.1; 137/396; 137/206; 4/323

[58] Field of Search ..... 137/205, 236.1, 392, 137/396, 206; 4/300, 323

[56] References Cited

U.S. PATENT DOCUMENTS

| | | | |
|---|---|---|---|
| 355,163 | 12/1886 | Grunsky | 137/236.1 X |
| 482,439 | 9/1892 | Liernur | 137/236.1 |
| 1,710,048 | 4/1929 | Earl | 137/236.1 X |
| 3,211,167 | 10/1965 | Clift et al. | 137/236.1 |
| 3,686,693 | 8/1972 | Liljendahl | 137/205 X |
| 3,730,884 | 5/1973 | Burns et al. | 137/236.1 X |
| 3,746,032 | 7/1973 | Wallgren | 137/205 |
| 4,370,227 | 1/1988 | Michael | 137/205 X |
| 4,663,056 | 5/1987 | Leech | 137/205 X |

FOREIGN PATENT DOCUMENTS

| | | |
|---|---|---|
| 0239892 | 10/1987 | European Pat. Off. . |
| 2117353 | 10/1972 | Germany . |
| 2641110 | 1/1978 | Germany . |

*Primary Examiner*—John Rivell
*Attorney, Agent, or Firm*—Lorusso & Loud

[57] ABSTRACT

Sewage system comprised of a collector pipe with one or more house connections and to which collector pipe an air compressor and/or vacuum pump is connected, wherein a house connection is comprised of a collection gully with a connection for the sewer pipe, and which gully, at its bottom side is provided with a valve, which may be operated under the control of a level switch arranged in the gully, while the valve at the discharge side is connected to the collected pipe which at that place is provided with a bend situated in a vertical plane, to the middle part of which the valve is connected and from which both the sideways running bend parts run upwards to a height below the valve.

3 Claims, 1 Drawing Sheet

SEWAGE SYSTEM

The invention relates to a sewage system of the type according to the preamble of claim 1.

Such a sewage system is disclosed in EP-A-0 239 892. In this known sewage system the valve of each collecting gully is operated at a predetermined maximum water level in the collecting gully. The compressor and/or vacuum pump provides for a transport through the collector pipe of the sewage water emptied from the gully into the collector pipe.

The drawback of the mere application of a compressor and/or a vacuum pump lies in the circumstance, that the consumption of energy is high, as in substance air is thereby circulated or sucked through the collector pipe, without this helping along in an efficient manner the flow of the sewage water in the pipe.

The invention aims to obviate this drawback of the known sewage system.

To this end the sewage system of the invention is characterized by the features of the characterizing part of claim 1.

In this manner the sewage water of all connecting gullies is transported through the collector pipe in one operation of the compressor and/or the vacuum pump which results in a more efficient operation of the sewage system.

Further, it is not required with the sewage system according to the invention that the compressor and/or the vacuum pump are continuously in operation, and these can be put into operation solely and directly after the discharge of the sewage water in the gully into the collector pipe, by which an important saving of energy is obtained.

A favorable embodiment of the sewage system of the invention is further characterized by the features of claim 2.

In a favorable way the bend according to a further characteristic of the invented sewage system further has a capacity which is sufficient to take in the maximum content of sewage water in the collecting gully.

Through the application of the bends near the house connections it is achieved, that after the discharge of the sewage water out of the collecting gullies, the collector pipe near the bends is completely shut off by the sewage water, by which at the pushing away or sucking in of the sewage water in the collector pipe the energy losses through air leakages in the collector pipe above the sewage water are substantially diminished.

The invention will now be described, by way of example, with reference to the accompanying drawings.

Figure 1:
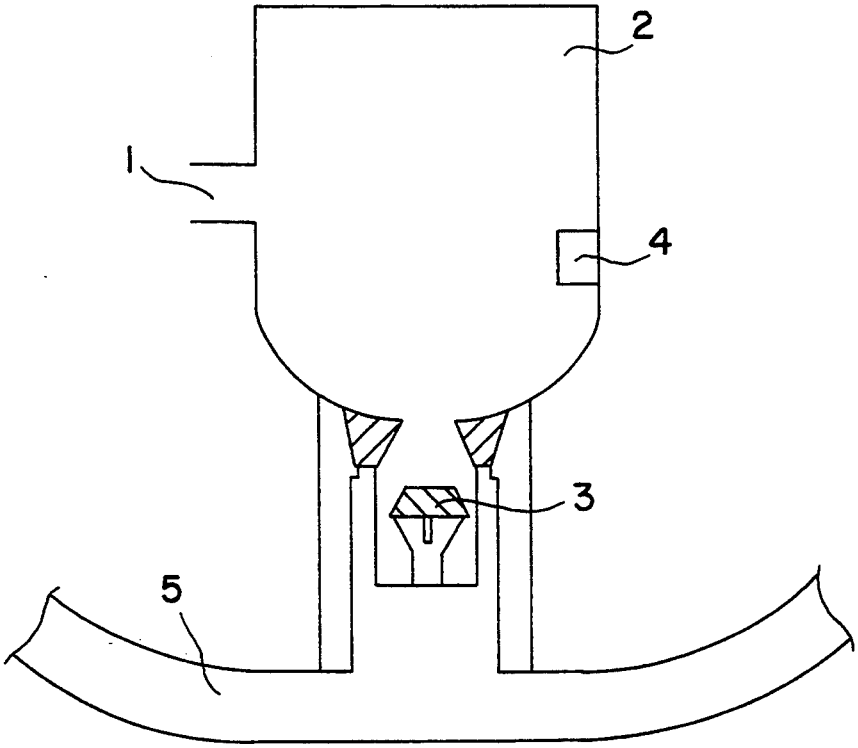
FIG. 1 shows a representation of a collecting gully with a connection to a collector pipe and a connection to a house sewer pipe.

As is shown in FIG. 1 the house sewer pipe 1 is connected to the collecting gully 2, and which at its bottom side is provided with a valve 3, which may be operated under the control of a level switch 4 arranged in the gully 2, such, that at the reaching of a determined maximum content of sewage water in the gully, the valve 3 is opened through an electrical means and the content of the gully may flow away downwards to be taken in in the bend 5, which forms part of the collector pipe.

Figure 2:
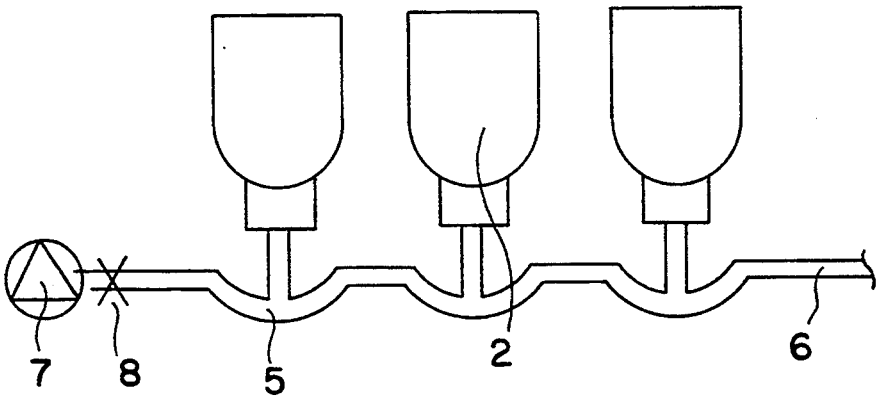
FIG. 2 shows a schematic representation of the sewage system.

As is shown in FIG. 2, the collector pipe 5, 6 below each collecting gully 2 is provided with a bend 5 which can take in the maximum content of a collecting gully.

At the end opposite from the direction of the flow of the sewage water the collector pipe 6 is connected to the compressor 7, by means of which after the opening of the valve 8 the content of the bends 5 may be pushed away to the discharge side of the collector pipe.

The connections of the gullies 2 to the collector pipe 5, 6 and the circuit of the level switches of the combined gullies is such that, when in a gully the level switch at the reaching of the maximum height of the sewage water within the gully is operated, by that all the valves of the combined gullies 2 are opened, and the contents of the gullies are taken in in the bends situated bends 5 of the collector pipe 5, 6.

Next the valves 3 of the gullies 2 are closed, the compressor 7 is put into operation and the valve 8 is opened, and after which the sewage water is pushed away out of the bends 5.

I claim:

1. A sewage system comprising:

a collector pipe having first and second ends;

a plurality of house connections;

an air compressor being connected to the first end of said collector pipe;

wherein each of said house connections comprises a collecting gully having a connection for a house sewer pipe, said gully being provided with a valve and a level switch arranged in said gully, said valve having a discharge side, wherein the discharge side of each valve being series connected by said collector pipe; and wherein the sewage system is arranged in such a manner that, upon operation of the level switch in the collecting gully of one of said plurality of house connections said compressor is put into operation and said valve for each said house connection gully closes to transport sewage water of all the collecting gullies to the second end of the collecting pipe.

2. The sewage system according to claim 1, wherein a bend is provided in said collector pipe at the location of each house connection and wherein said valve of said collecting gully is connected to a middle part of said bend.

3. The sewage system according to claim 2, wherein said bend has a capacity that is sufficient to receive all the sewage water contained from the corresponding collecting gully.

* * * * *